US010737878B2

(12) United States Patent
Sweaney et al.

(10) Patent No.: US 10,737,878 B2
(45) Date of Patent: Aug. 11, 2020

(54) RECEPTACLE LINER

(71) Applicant: Inteplast Group Corporation, Livingston, NJ (US)

(72) Inventors: William Edward Sweaney, Cibolo, TX (US); Peter W. Zamarripa, Palacios, TX (US)

(73) Assignee: Inteplast Group Corporation, Livingston, NJ (US)

( * ) Notice: Subject to any disclaimer, the term of this patent is extended or adjusted under 35 U.S.C. 154(b) by 48 days.

(21) Appl. No.: 15/365,255

(22) Filed: Nov. 30, 2016

(65) Prior Publication Data

US 2018/0065801 A1 Mar. 8, 2018

Related U.S. Application Data

(60) Provisional application No. 62/261,076, filed on Nov. 30, 2015.

(51) Int. Cl.

| | |
|---|---|
| ***B65D 33/16*** | (2006.01) |
| ***B65D 33/28*** | (2006.01) |
| ***B65F 1/00*** | (2006.01) |
| ***B65D 25/16*** | (2006.01) |

(52) U.S. Cl.

CPC ..... *B65F 1/002* (2013.01); *B65D 25/16* (2013.01); *B65D 33/28* (2013.01); *B65F 2250/114* (2013.01)

(58) Field of Classification Search

CPC .... B65D 33/16; B65D 33/1691; B65D 33/18; B65D 33/20; B65D 33/01; B65D 33/28; B65F 1/06; B65F 1/065

USPC ..... 383/2, 4, 37, 71–77, 210–211, 93, 100, 383/101; 220/495.11

See application file for complete search history.

(56) References Cited

U.S. PATENT DOCUMENTS

| | | | | |
|---|---|---|---|---|
| 3,128,936 | A * | 4/1964 | Sprosty | B29C 66/346 383/107 |
| 3,204,855 | A * | 9/1965 | Boynton | A61J 9/001 215/11.3 |
| 4,036,363 | A * | 7/1977 | Kugler | B65B 43/36 206/526 |
| 4,096,987 | A * | 6/1978 | Rodish | B65D 33/02 383/119 |
| 4,558,801 | A * | 12/1985 | Vilutis | B65D 25/16 217/12 R |
| 4,842,421 | A * | 6/1989 | Bullard | B65D 33/20 383/61.4 |
| 7,422,105 | B2 * | 9/2008 | Loyd | A61F 13/55185 206/438 |
| 8,523,439 | B2 | 9/2013 | Ross | |

(Continued)

*Primary Examiner* — Jes F Pascua
*Assistant Examiner* — Nina K Attel
(74) *Attorney, Agent, or Firm* — Stinson LLP

(57) ABSTRACT

A liner for lining a receptacle has a front panel and a rear panel that define an interior and a top opening in fluid communication with the interior. A frangible sizing seal structure joins together the front and rear panels along the top of the liner adjacent a side of the liner. The sizing seal structure limits a size of the liner opening and is configured to be selectively broken to separate the front and rear panels to enlarge the size of the liner opening so that the top edge margin fits over a rim of the receptacle. In a method of making the liner, the front and rear panels are sealed together to form the frangible sizing seal structure.

14 Claims, 7 Drawing Sheets

(56) References Cited

U.S. PATENT DOCUMENTS

| | | | | |
|---|---|---|---|---|
| 2006/0165319 | A1* | 7/2006 | Patridge | B65F 1/0006 383/107 |
| 2008/0063325 | A1* | 3/2008 | Miller | B65D 75/20 383/211 |
| 2011/0026856 | A1* | 2/2011 | Lopez-Araiza | B26F 1/44 383/10 |
| 2011/0229061 | A1* | 9/2011 | Bertrand | B65D 33/28 383/75 |

* cited by examiner

RECEPTACLE LINER

FIELD

The present disclosure generally relates to liners for lining receptacles, and more particularly to a liner configured to securely grip the rim of a receptacle in use.

BACKGROUND

Liners are used to line waste cans and other receptacles. Conventional liners have closed bottom ends and open top ends. Typically, when liners are placed into a receptacle, the top end portion of the liner is loosely fitted around the rim to secure the liner to the receptacle. Conventional liners lack features for securely gripping the rim of the receptacle and are, therefore, prone to fall off in use.

SUMMARY

In one aspect, a liner for lining a receptacle has a bottom edge margin, a top edge margin, a first side margin, a second side margin, and a width extending between the first side margin and the second side margin. The liner comprises a front panel and a rear panel joined together along the bottom edge margin, the first side margin, and the second side margin and defining a liner interior therebetween. The front panel and the rear panel are unconnected along a segment of the top edge margin of the liner to define a liner opening in fluid communication with the liner interior. The liner further comprises a frangible sizing seal structure joining together the front and rear panels along the top edge margin adjacent the first side margin. The frangible sizing seal structure limits a size of the liner opening and is configured to be selectively broken to separate the front and rear panels at the frangible sizing seal structure to enlarge the size of the liner opening so that the top edge margin fits over a rim of the receptacle.

In another aspect, a method of making a liner for lining a receptacle comprises forming a front panel and a rear panel that are joined together along a bottom edge margin, a first side margin, and a second side margin of the liner to define a liner interior and that are unconnected along a segment of a top edge margin of the liner extending between the first and second side margins to define a liner opening in fluid communication with the liner interior. The front and rear panels are sealed together along the top edge margin adjacent the first side margin to limit a size of the liner opening. Said step of sealing together the front and rear panels comprises forming a frangible sizing seal structure configured to allow the frangible sizing seal structure to progressively break when the top edge margin of the liner is stretched over a rim of the receptacle to selectively enlarge the size of the liner opening.

Other aspects, objects, and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
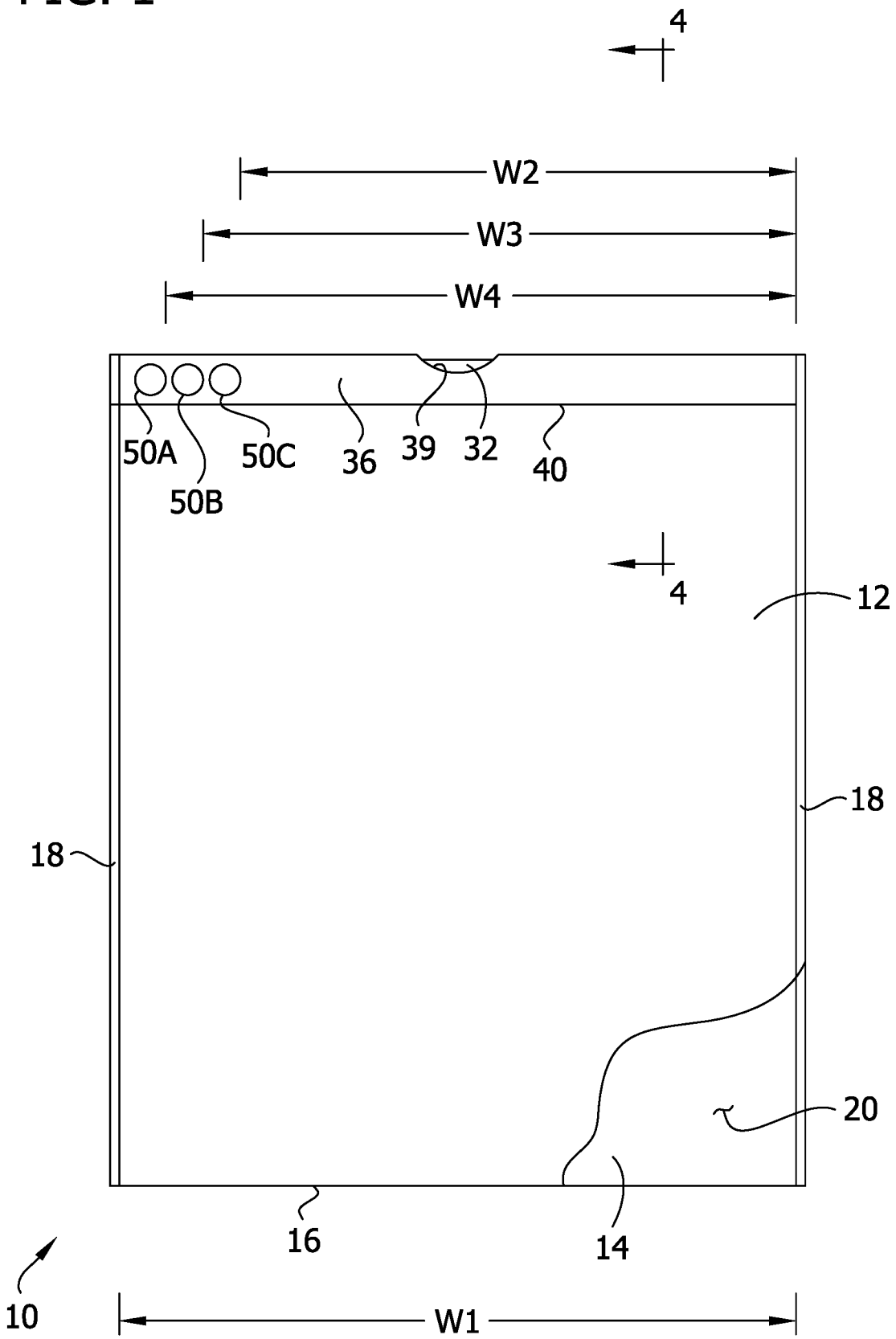
FIG. 1 is a front elevation of a liner with a portion of a front panel broken away.
Figure 2:
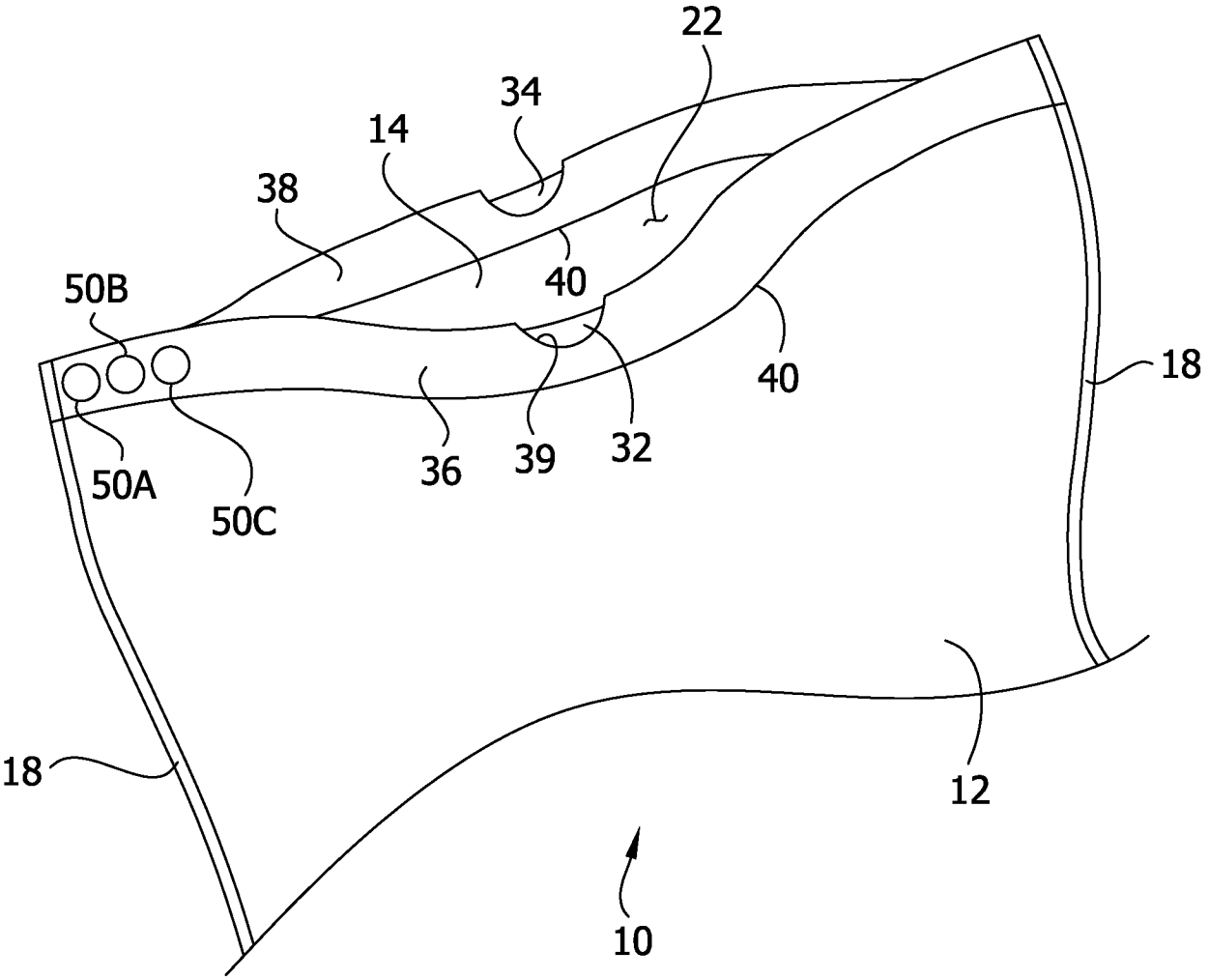
FIG. 2 is a fragmentary perspective of the liner in a partially opened configuration.
Figure 3:
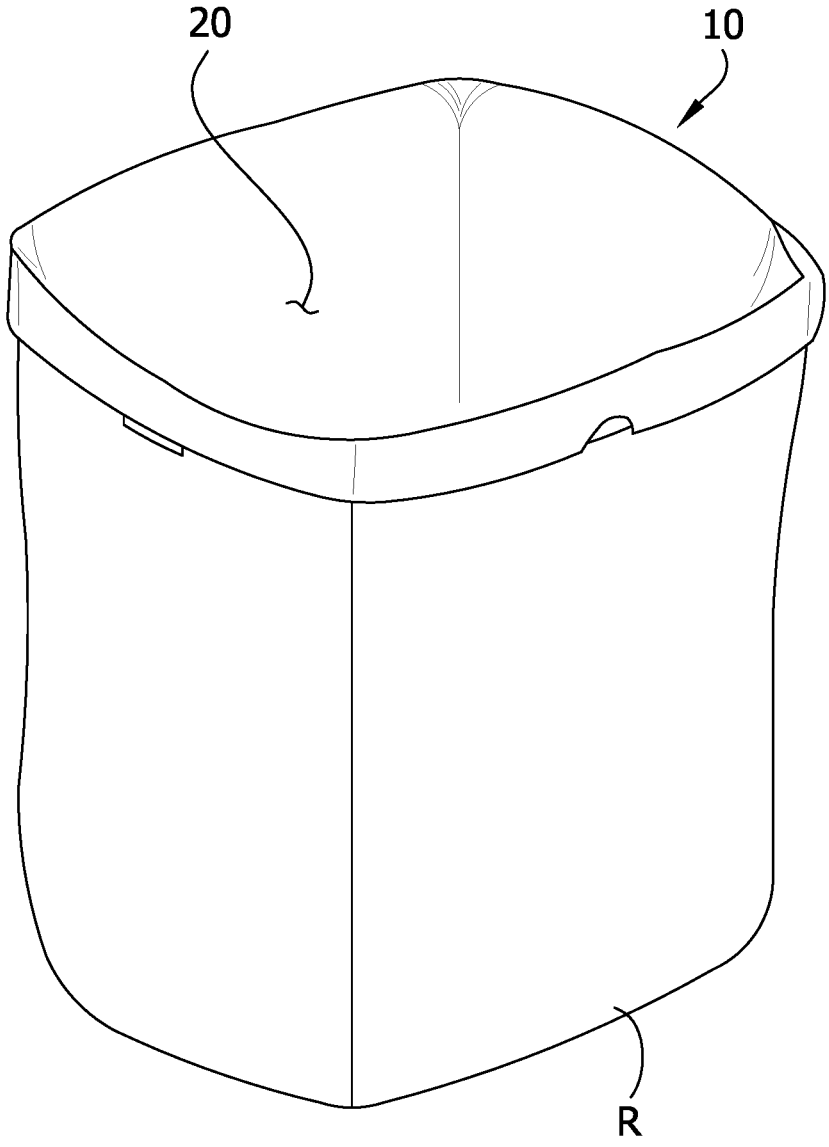
FIG. 3 is a perspective of the liner received in a receptacle.

Referring to FIGS. 1-3, a liner for lining a receptacle R (FIG. 3), such as a wastebasket, is generally indicated at reference number 10. The liner 10 is constructed from liner panels that extend around an interior volume 20 and form a bottom of the liner that is closed and an opening 22 at the top of the liner. As will be discussed in further detail below, the liner 10 is adjustable to permit the size of the opening 22 to be selectively enlarged. When the liner 10 is placed into a receptacle R, the size of the opening 22 can be chosen so that the top end portion of the liner securely grips the rim The illustrated liner 10 has a two-panel bag configuration. It is contemplated that other configurations, such as gusseted bag configurations, can also be used without departing from the scope of the invention. The liner has a front panel 12 and a rear panel 14. The front and rear panels 12, 14 are joined together along a bottom edge margin and opposite side margins of the liner 10 to define the liner interior 20. In the illustrated embodiment, the front and rear panels 12, 14 are formed from a single sheet of polymeric film that is folded along a bottom fold 16. Thus, the front and rear panels 12, 14 are joined together along the bottom edge margin of the liner 10 by being formed from one folded piece of material. In other embodiments, it is contemplated that the front and rear panels 12, 14 can be separate sheets of material that are joined together along the bottom edge margins of the liner 10. The front and rear panels 12, 14 are also joined together along the side margins of the liner by side seals 18. The side seals preferably extend along the height of the liner 10 from the bottom end to the top end. In one or more preferred embodiments, the side seals 18 are formed by heat sealing the front and rear panels 12, 14 along the side margins of the liner 10. The illustrated side seals 18 permanently fuse together the front and rear panels 12, 14 so that they cannot be separated at the side seal without damaging the liner 10. Preferably, the side seals 18 and fold 16 form liquid and/or fluid-tight edges of the liner so that materials placed in the liner 10 do not escape during use. The distance between the side seals 18 defines the width W1 of the liner interior 20.

Figure 4:
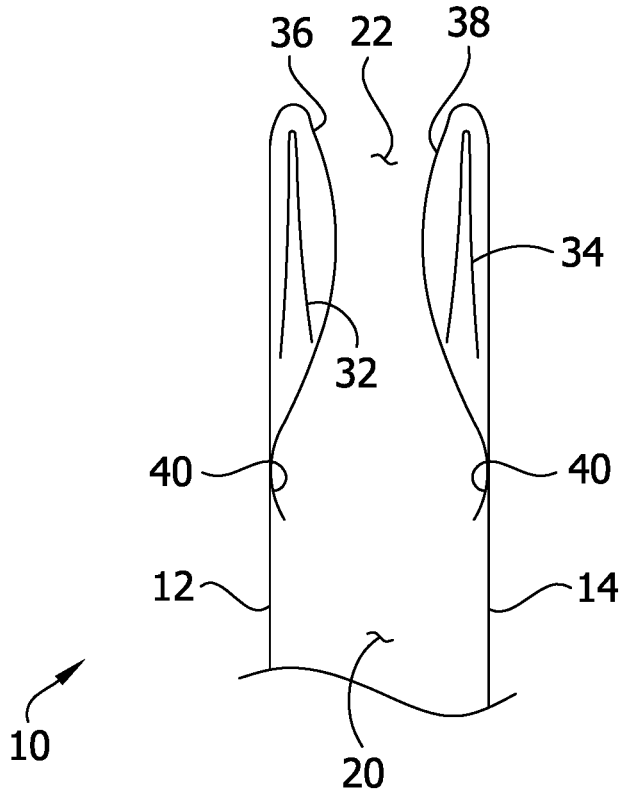
FIG. 4 is a fragmentary section of the liner taken in the plane of line 4-4 of FIG. 1.

The liner 10 is a drawstring liner. Liners without drawstrings can also be used without departing from the scope of the invention. Referring to FIG. 2, the illustrated liner 10 includes a front drawstring 32 that extends along the top end margin of the front panel 12 and a separate rear drawstring 34 that extends along the top end margin of the rear panel 14. It is also contemplated that a single drawstring that extends circumferentially around the liner opening 22 could be used without departing from the scope of the invention. As shown in FIG. 4, each drawstring 32, 34 comprises a strip of polymeric film that is folded in half along its length. In other embodiments, the drawstrings can comprise unfolded strips or strips that have been folded lengthwise along more than one fold without departing from the scope of the invention. The drawstrings 32, 34 can suitably be formed from elastic or inelastic material.

Each of the drawstrings 32, 34 is received in a hem 36, 38 of the respective one of the front and rear panels 12, 14. In a preferred embodiment, the front hem 36 is formed by folding a top marginal portion of the front panel 12 inward over the drawstring 32 and sealing the panel to itself along the seal 40 so that the front drawstring is received within the front hem. The rear hem 38 is likewise formed by folding a top marginal portion the rear panel 14 inward over the rear drawstring 34 and sealing the panel to itself along the seal 40 so that the rear drawstring is received within the rear hem. It will be understood that a suitable hem could also be formed by folding the top marginal portion of a liner panel outward and sealing the panel to itself. Still other hem constructions may also be used without departing from the scope of the invention. Preferably, at least one of the drawstrings 32, 34 and hems 36, 38 is formed from an elastic material so that when the top end margin of the liner 10 is stretched over the rim of a receptacle R, the liner resiliently returns toward its previous size and shape to grip the receptacle.

Referring to FIG. 2, the front and rear drawstrings 32, 34 are anchored to the front and rear panels 12, 14 so that they may be tightened to cinch the liner 10 closed. In a preferred embodiment, the side seals 18 extend upward through the hems 36, 38. Likewise, the drawstrings 32, 34 extend along the entire width of the liner 10 so that a portion of each drawstring intersects each side seal 18. Thus, when the side seals 18 are formed, they seal each drawstring 32, 34 to its respective panel 12, 14 to anchor the drawstrings to the side margins of the liner 10. As discussed above, the side seals 18 can be formed by heat sealing the front and rear panels 12, 14 together along the side margins of the liner 10. Preferably, the side seals 18 permanently fuse the front hem 36, front drawstring 32, rear hem 38, and rear drawstring 34 together so that none of these components of the liner 10 can be separated at the seals 18 without damaging the liner. Thus, each of the drawstrings 32, 34 is anchored to the liner 10 at each of the opposite side margins of the liner by the side seals 18. A notch 39 is formed in each of the hems 36, 38 between the side margins of the liner so that a user can access and manipulate the drawstrings 32, 34. Pulling the drawstrings 32, 34 through the notches 29 draws the side margins of the top end margin of the liner 10 inward to cinch the liner closed. In certain embodiments (not shown), perforations or another type of zone of weakness is formed at the top corners of the liner as described in U.S. Pat. No. 3,010,640. The perforations allow corner portions of the liner 10, which include the sealed together panels 12, 14, to separate from the remainder of the liner panels. The separated corner portions remain attached to the drawstrings 32, 34, and can be used to tighten the drawstrings and close the liner 10.

Sizing seals 50A-50C are formed along the top edge margin of the liner 10 adjacent one of the side seals 18 to facilitate sizing of the opening 22 to correspond to the size of an open top of the receptacle R. The sizing seals 50A-50C comprise frangible sizing seal structure in this embodiment. Although the illustrated embodiment includes the sizing seals 50A-50C on one side of the liner 10, the sizing seals could be formed at both sides of the liner as discussed in further detail below. The sizing seals 50A-50C connect the front and rear panels 12, 14 at the top corner portion of the liner 10. In one or more embodiments, the sizing seals 50A-50C are spaced apart from one another so that an unsealed portion of the top edge margin of the liner extends between each pair of adjacent sizing seals. In the illustrated embodiment each sizing seal 50A-50C has a circular shape, but sizing seals of other shapes can also be used without departing from the scope of the invention. The illustrated liner 10 includes three sizing seals 50A-50C, including an outer sizing seal 50A, a central sizing seal 50B, and an inner sizing seal 50C. Other numbers of sizing seals can also be used without departing from the scope of the invention. As shown in FIG. 1, the inner sizing seal 50C and the opposite side seal 18 define an initial width W2 of the liner opening 22, which is narrower than the width W1 of the liner interior 20.

The sizing seals 50A-50C are suitably formed by heat sealing the top edge margin of the liner 10 to at least partially fuse together the front and rear panels 12, 14. In a preferred embodiment, the sizing seals 50A-50C fuse together each of the front hem 36, front drawstring 32, rear hem 38, and rear drawstring 40. But unlike the side seals 18, the sizing seals 50A-50C are configured to fail or break when the top end margins of the front and rear panels 12, 14 are pulled apart with a sufficiently large pulling force. For example, in one or more embodiments the side seals 50A-50C are frangible to allow the front and rear panels 12, 14 to separate at the sizing seals 50A-50C when pulled apart with a sufficiently large pulling force.

In one embodiment, the seal strength of each of the sizing seals 50A-50C is substantially the same. The seal strength may be understood to be the maximum force to which a sizing seal can be subjected just prior to or at the time of breaking. The frangible seals 50A-50C can never-the-less be broken in sequence from the inner sizing seal 50C to the outer sizing seal 50A. The inner sizing seal 50C will be subject to the larger force when the opening 22 of the liner 10 is being expanded to fit over the edges of the receptacle R. Moreover, the inner sizing seal 50C, prior to breaking, is believed to shield the central and outer sizing seals 50B, 50A from the force being applied to expand the opening 22 of the liner. Thus, the inner sizing seal 50C can break without also breaking the middle sizing seal 50B or outer sizing seal 50A. However, if the liner opening 22 is still not large enough to fit over the edges of the receptacle R, the force expanding the opening is next experienced by the central sizing seal 50B. It will be understood that the central seal 50B and then the outer sizing seal 50A can be broken in sequence, until the liner opening 22 can be fitted over the edge of the receptacle R. The seal strength is selected so that a sizing seal 50A-50C can resist sufficient force to allow the liner 10 to grip the receptacle R for holding the liner against falling into the receptacle in use.

In another embodiment, the strength of the sizing seals 50A-50C at the corner of the liner 10 increases sequentially from the inner sizing seal 50C to the outer sizing seal 50A. For example, the inner sizing seal 50C has a seal strength that is less than the seal strength of the central sizing seal 50B, and the central sizing seal 50B has a seal strength that is less than the outer sizing seal 50C. As a result, the amount of force required to separate the panels 12, 14 at the inner sizing seal 50C is less than the amount of force required to separate the panels at the central sizing seal 50B. The amount of force required to separate the panels 12, 14 at the central sizing seal 50B is likewise less than the amount of force required to separate the panels at the outer sizing seal 50A. Several methods for varying the seal strengths of the sizing seals 50A-50C will be discussed in further detail below.

In use, the frangible sizing seals 50A-50C allow the width of the liner opening 22 to be selectively increased. As discussed above, in an initial configuration, the inner sizing seal 50C and the opposite side seal 18 define the initial width W2 of the liner opening 22, which is considerably narrower than the width W1 of the liner interior 20. The narrow width W2 of the liner opening allows the top end margin of the liner 10 to be stretched over a relatively small receptacle R, so that the liner elastically grips the rim of the receptacle. If, however, the receptacle R is too large for the narrowest liner opening width W2, a user can pull the panels 12, 14 apart until they separate at the inner sizing seal 50C. Because the amount of force required to separate the panels 12, 14 at the inner sizing seal 50C is less than the amount of force required to separate the panels at the central sizing seal 50B, the central sizing seal does not fail. After the inner sizing seal 50C fails, the central sizing seal 50B and the opposite side seal 18 then define a width W3 of the liner opening 22. If the receptacle R is too large for the liner opening width W3, the user can pull the panels 12, 14 apart until they separate at the central sizing seal 50B. Because the amount of force required to separate the panels 12, 14 at the central sizing seal 50B is less than the amount of force required to separate the panels at the outer sizing seal 50A, the outer sizing seal 50A does not fail. After the central sizing seal 50B fails, the outer sizing seal 50A and the opposite side seal 18 then define a width W4 of the liner opening 22. If the receptacle R is too large for the liner opening width W4, the user can pull the front and rear panels 12, 14 apart until they separate at the outer sizing seal 50A. After the outer sizing seal 50A has been broken, the side seals 18 define the liner opening 22 so that the width of the liner opening is the same as the width W1 of the liner interior 20. Thus, the frangible sizing seals 50A-50C allow the width of the liner opening 22 to be selectively increased to size the liner 10 for gripping the rim of different receptacles R.

In a preferred embodiment, as the user fits the top end margin of the liner 10 over a receptacle R, the sizing seals 50A-50C automatically and sequentially break based on the amount for force used to stretch the liner over the rim of the receptacle. If the top end margin of the liner 10 must be stretched to be fitted over the rim of a receptacle R, the amount of stretching required is a function of the size of the receptacle rim. Likewise, when the top end margin of the liner 10 is stretched by pulling the front and rear panels 12, 14 apart, the amount of stretching provided is a function of the pulling force. The amount of stretching can be measured as an increase in the circumference of the liner opening 22.

The sizing seals 50A-500 are suitably configured to automatically fail to increase the size liner opening 22 as the liner 10 is stretched over the rim of the receptacle R. Thus, it is not necessary for the user to configure the size of the liner opening 22 prior to application of the liner 10 to the receptacle R. Generally, the pulling force imparted on the liner 10 increases as the liner opening 22 stretches from an initial circumference (broadly, the initial size of the opening). When the pulling force reaches an amount that corresponds with a maximum stretch from the initial circumference, the inner sizing seal 50C automatically fails. After the inner sizing seal 50C fails, a second circumference becomes the resting circumference of the liner opening 22 (i.e., the circumference of the liner opening when the liner 22 is not stretched). The pulling force increases further as the liner opening circumference stretches from the second circumference. When the pulling force reaches an amount that corresponds with a maximum stretch from the second circumference, the central sizing seal 50B automatically fails. After the central sizing seal 50B fails, a third circumference becomes the resting circumference of the liner opening 22. As the circumference of the liner opening 22 stretches further from the third circumference, the pulling force continues to increase. When the pulling force reaches an amount that corresponds with a maximum stretch from the third circumference, the outer sizing seal 50A automatically fails, and a fourth circumference becomes the resting circumference of the liner opening 22. It will be understood that when the outer sizing seal 50A is broken the width of the opening is equal to the width W1 between the seals 18. Thus, it can be seen that the sizing seals 50A-50C can be configured to automatically and sequentially fail so that the liner 10 is always sized to grip the rim of the receptacle R in which it is placed.

To make a plurality of the liners 10 in a mass manufacturing process, a tube of polymeric film is preferably extruded and cut to form a film sheet. The film sheet is folded along a longitudinal fold line to define the bottom folds 16 of the liners 10. The manufacturer can also optionally fold two strips of drawstring film along respective longitudinal fold lines to form the folded drawstrings shown in FIG. 4. The drawstring film, which is a unitary strip that is later separated to form the drawstrings of multiple liners 10, is then placed adjacent the top edge margins of the folded liner film, and the top edge margins are folded over the drawstring film and sealed to enclose the drawstrings 32, 34 in the hems 36, 38. With the drawstrings 32, 34 received in the hems 36, 38, the manufacturer uses heat sealing bars to form the side seals 18. The seals 18 are formed to fuse together the front hem 36, front drawstring 32, rear hem 38, and rear drawstring 34 at each side seal. At the same time or at a subsequent time, the individual liners 10 and drawstrings 32, 34 are separated from one another using any suitable technique (e.g., cutting, etc.).

Figure 5:
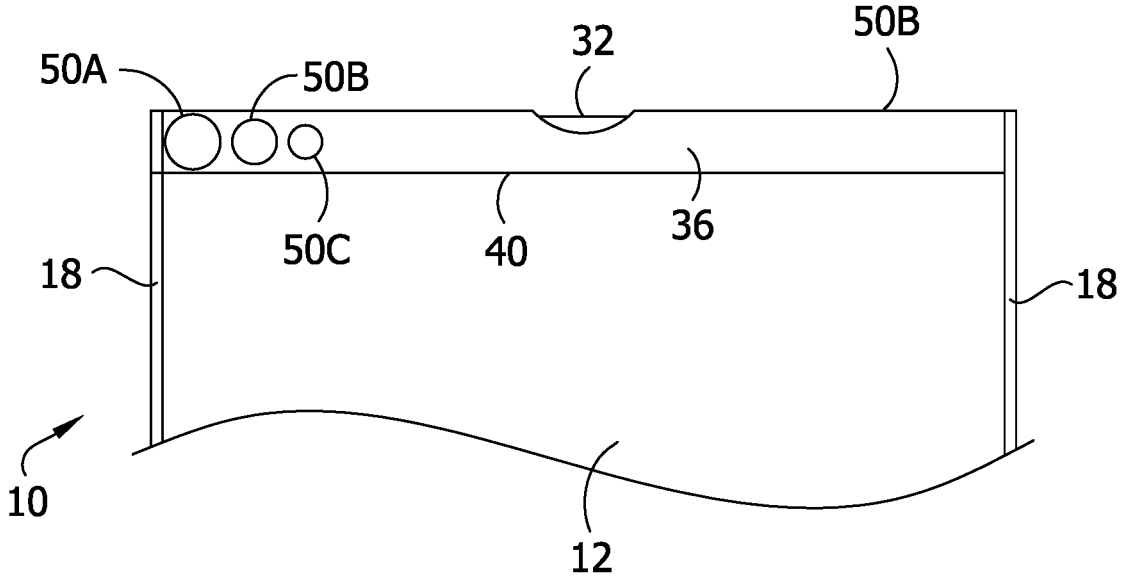
FIG. 5 is a fragmentary elevation of another embodiment of a liner.

To form the sizing seals 50A-50C, opposing heat sealing members are pressed against the front and rear panels 12, 14. This can be done at any point in the manufacturing process detailed above after the film sheet has been folded to form the bottom fold 16 of the liners 10, but preferably it is performed after the hems 36, 38 enclose the drawstrings 32, 34. Multiple variables can be adjusted to adjust the strength of the sizing seals 50A-50C to achieve the desired effect. Variables that affect seal strength include the size of the sealing members used for each sizing seal, the length of time the sealing members contact the panels, and the set point temperatures of the sealing members. All other variables being equal, an increase set point temperature, contact duration, and/or heat sealing member size is thought to increase the seal strength of the resulting sizing seal. Thus, in one or more embodiments, the set point temperature of the heat sealing member used to form the inner sizing seal 50C is less than the set point temperature used for the central sizing seal 50B, which is likewise less than the set point temperature used for the outer sizing seal 50A. Additionally or in the alternative, the contact duration used to form the inner sizing seal 50C is less than the contact duration used to form the central sizing seal 50B, which is likewise less than the contact duration used to form the outer sizing seal 50A. As shown in FIG. 5, in one or more embodiments, the heat sealing member used to form the inner sizing seal 50C has a smaller contact area than the heat sealing member used to form the central sizing seal 50B, which likewise has a smaller contact area than the heat sealing member used to form the outer sizing seal 50A (i.e., in the embodiment shown in FIG. 5, the outer sizing seal 50A extends over a larger area than the central sizing seal 50B and the intermediate sizing seal extends over a larger area than the inner sizing seal 50C). Variations in the seal strength adjustment variables can also be combined to form sizing seals 50A-50C of different seal strengths.

Figure 6:
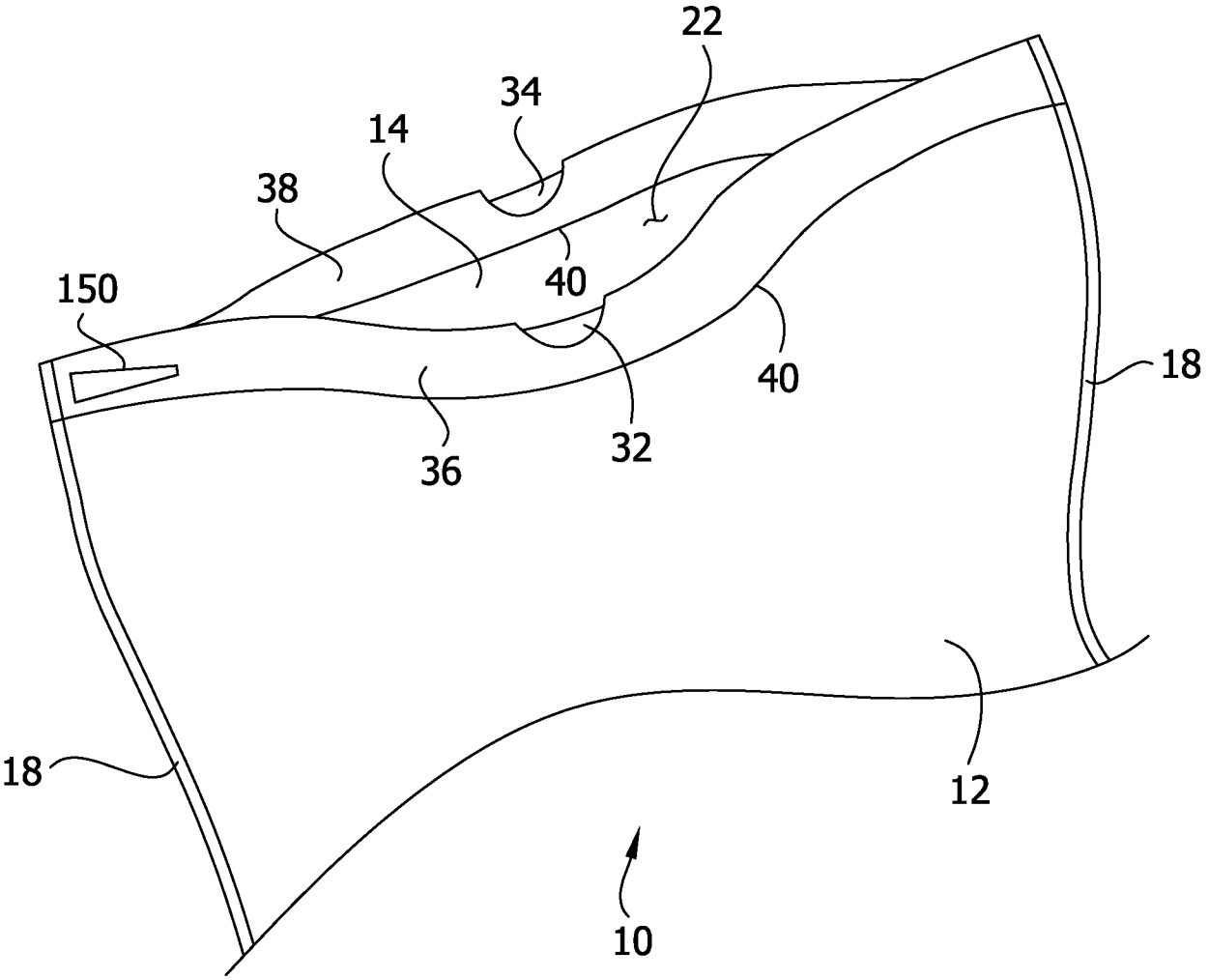
FIG. 6 is a fragmentary perspective similar to FIG. 2 of another embodiment of a liner.
Figure 7:
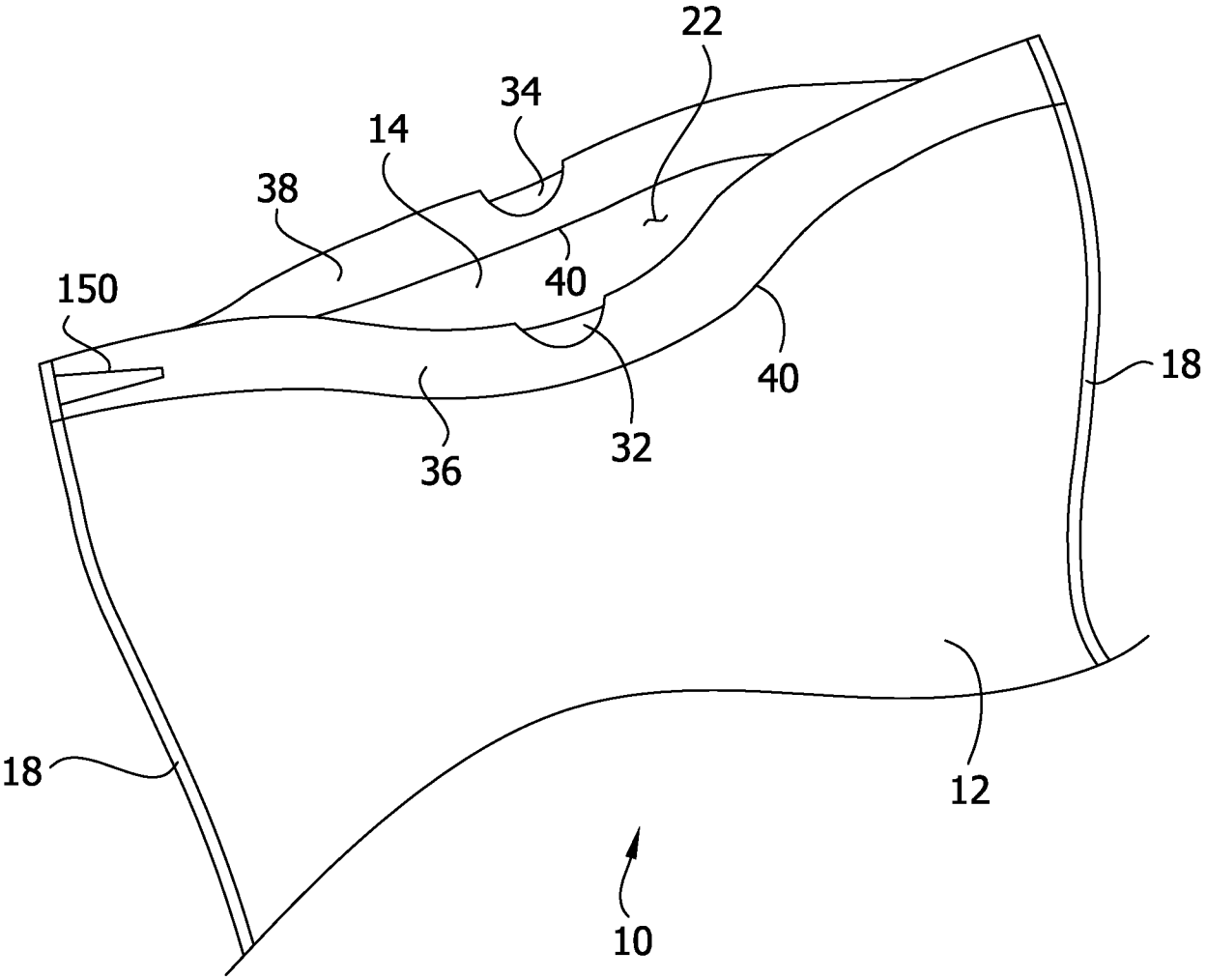
FIG. 7 is a fragmentary perspective similar to FIG. 2 of still another embodiment of a liner.

Referring to FIGS. 6 and 7, certain embodiments of the liner 10 can be constructed to include only a single contiguous sizing seal 150 (broadly, "sizing seal structure") at the corner of the liner opening 22. Each sizing seal 150 has as a width extending from an outboard end portion adjacent the respective side seal 18 to an inboard end portion. In the embodiment of FIG. 6, the outboard end portion of the sizing seal 150 is spaced apart from the side seal 18, but in FIG. 7 the outboard end portion adjoins the side seal. Each sizing seal 150 has a height extending from a bottom edge to a top edge. The height of each sizing seal 150 decreases as the sizing seal extends inward from its outboard end to its inboard end. In the illustrated embodiment, the top and bottom edges angle inward toward one another at substantially constant angles as the sizing seal 150 extends inward. But in other embodiments, the sizing seals could have other shapes without departing from the scope of the invention. Because each sizing seal 150 is narrower adjacent its inboard end than its outboard end, the seal strength of each sizing seal is greater adjacent the outboard end. Moreover, the width of each sizing seal 150 increases gradually as the sizing seal extends from the inboard to the outboard end, the strength of each sizing seal 150 likewise increases gradually toward the outboard end. Thus, a weaker inboard portion of the sizing seal 150 can fail, without an outboard portion of the sizing seal failing, to increase the size of the liner opening. Preferably, the sizing seals 150 are configured so that inboard portions automatically fail as the liner 10 is stretched over the rim of the receptacle R to increase the size of the liner opening 22 to fit the receptacle.

Figure 8:
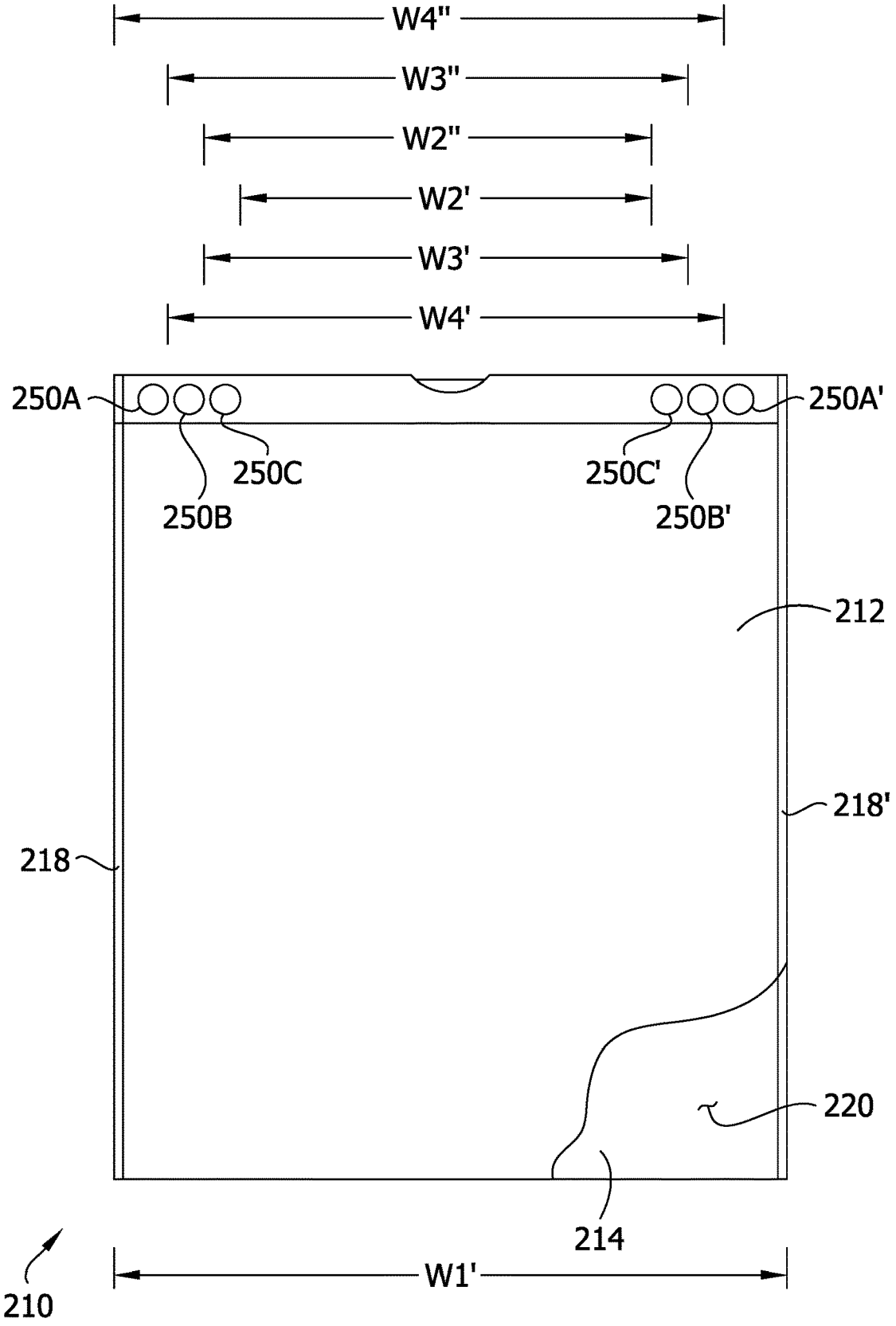
FIG. 8 is front elevation of another liner with a portion of a front panel broken away.

Referring to FIG. 8, in another embodiment, a liner, generally indicated at 210, comprises a front panel 212 and a rear panel 214 joined together at side seals 218, 218' to define a liner interior 220 having a width W1'. Sizing seals 250A-250C (broadly, "sizing seal structure") are formed along the top edge margin of the liner 10 adjacent one side seal 218 and sizing seals 250A'-250C' (broadly, "sizing seal structure") are formed along the top edge margin of the liner adjacent the opposite side seal 218' to facilitate sizing of the opening of the liner 210 to correspond to the size of an open top of the receptacle R. Thus, the illustrated liner 210 includes three sizing seals on each side of the liner, including outer sizing seals 250A, 250A', central sizing seals 250B, 250B', and inner sizing seals 250C, 250C'. Other numbers of sizing seals can also be used without departing from the scope of the invention. The seal strength of the sizing seals 250A-250C, 250A'-250C' increases sequentially from the respective inner seal to the respective outer seal so that the size of the opening of the liner 210 can be gradually increased as the top edge margin of the liner is stretched over the rim of a receptacle R.

In one or more embodiments, each inner sizing seal 250C, 250C' has about the same seal strength, each central sizing seal 250B, 250B' has about the same seal strength, and each outer sizing seal 250A, 250A' has about the same seal strength. In these embodiments, the inner sizing seals 250C, 250C' fail at about the same time when top end margin of the liner 10 is stretched over the rim of a receptacle R. When the inner sizing seals 250C, 250C' fail, the width of the liner opening increases from an initial width W2' extending between the inner sizing seals to a second width W3' extending between the central sizing seals 250B, 250B'. Further stretching of the top edge margin of the liner 10 causes the central sizing seals 250B, 250B' to fail at about the same time, increasing the width of the liner opening from the second width W3' to a third width W4' extending between the outer sizing seals 250A, 250A'. Still further stretching of the top edge margin of the liner 10 causes the outer sizing seals 250A, 250A' to fail at about the same time, which increases the width of the liner opening to be the same as the width W1' of the liner interior 220. As can be seen, using sizing seals 250A-250C, 250A'-250C' on both sides of the liner 210 increases the range of selectable liner opening widths as compared with a single set of liner seals 50A-50C having the same shapes and arrangement on only one side of the liner 10 (FIG. 1). However, the cost of manufacturing a liner 210 with sizing seals 250A-250C, 250A'-250C' on both sides of the liner may be higher than the cost of manufacturing a liner 10 with sizing seals 50A-50C on only one side of the liner.

Referring still to FIG. 8, in other embodiments, the inner, central and outer sizing seals 250A-250C, 250A'-250C' on each side of the liner 210 have different seal strengths. For example, in one embodiment, the seal strength of the sizing seals increases, from weakest to strongest, in the following order: first inner sizing seal 250C, second inner sizing seal 250C', first central sizing seal 250B, second central sizing seal 250B', first outer sizing seal 250A, and second outer sizing seal 250A'. By varying the seal strength of the sizing seals 250A-250C, 250A'-250C' on opposite sides of the liner 210, greater variation in the selectable widths of the liner opening can be achieved. For example, in the illustrated embodiment, gradually stretching the top edge margin of the liner 210 causes the width of the liner opening to increase from an initial width W2' to a second width W2" after the first inner sizing seal 250C fails; from the second width W2" to a third width W3' after the second inner sizing seal 250C' fails; from the third width W3' to a fourth width W3" after the first central sizing seal 250B fails; from the fourth width W3" to a fifth width W4' after the second central sizing seam 250B' fails; from the fifth width W4' to a sixth width W4" after the first outer sizing seal 250A fails; and from the sixth width W4" to the liner width W1' after the second outer sizing seal 250A' fails. Thus, by using different seal strengths on each side of the liner opening, a greater number of automatically configurable liner opening sizes can be achieved.

As can be seen, the sizing seals 50A-50C, 150, and 250A-250C, 250A'-250C' enable a single liner 10, 210 to define openings of different sizes. Thus, the liners 10, 210 can be selectively configured to securely grip the rims of receptacles R of different shapes and sizes to allow the same liner to be securely fitted into different kinds of receptacles.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A liner for lining a receptacle, the liner having a bottom edge margin, a top edge margin, a first side margin, a second side margin, a height extending between the bottom edge margin and the top edge margin, and a width extending between the first side margin and the second side margin, the liner comprising a front panel and a rear panel joined together along the bottom edge margin, the first side margin, and the second side margin and defining a liner interior therebetween, the front panel and the rear panel being unconnected along a segment of the top edge margin of the liner to define a liner opening in fluid communication with the liner interior, the liner further comprising a frangible sizing seal structure joining together the front and rear panels along the top edge margin adjacent the first side margin, the frangible sizing seal structure limiting a size of the liner opening and being configured to be selectively broken to separate the front and rear panels at the frangible sizing seal structure to enlarge the size of the liner opening so that the top edge margin fits over a rim of the receptacle;

wherein the liner opening is configured so that said segment of the top edge margin of the liner that defines the liner opening can be stretched over a rim of another smaller receptacle without any portion of the frangible sizing seal structure being broken;

wherein the frangible sizing seal structure comprises a plurality of sizing seals, the sizing seals being spaced apart from one another by an unsealed portion of the top edge margin of the liner; and wherein the plurality of two sizing seals are located at a corner portion of the liner such that:

the plurality of sizing seals are aligned with one another heightwise of the liner; and each of the plurality of sizing seals is located inboard of the first side margin of the liner and closer to the first side margin of the liner than the second side margin;

wherein the plurality of sizing seals comprise an outer sizing seal adjacent the first side margin, an inner sizing seal adjacent the opening, and a central sizing seal spaced apart between the inner sizing seal and the outer sizing seal;

wherein each of the inner, central, and outer sizing seals has a seal strength, the seal strength of the central sizing seal being greater than the seal strength of the inner sizing seal and less than the seal strength of the outer sizing seal.

2. The liner as set forth in claim 1 wherein the frangible sizing seal structure is configured to progressively enlarge the size of the liner opening.

3. The liner as set forth in claim 1 wherein the inner sizing seal is configured to break before the outer sizing seal when the top edge margin of the liner is stretched over the rim of the receptacle.

4. The liner as set forth in claim 3 wherein the outer sizing seal is configured to break after the inner sizing seal when the top edge margin of the liner is stretched further over the rim of the receptacle.

5. The liner as set forth in claim 1 wherein the frangible sizing seal structure is configured to be automatically broken as the liner is stretched over the rim of the receptacle to increase the size of the liner opening so that the top edge margin of the liner fits over the rim of the receptacle.

6. The liner as set forth in claim 1 wherein the front panel and the rear panel each form a hem extending along the top edge margin of the liner and the liner further comprises drawstrings received in respective ones of the hems.

7. The liner as set forth in claim 6 wherein the frangible sizing seal structure at least partially fuses together the hems and drawstrings.

8. The liner as set forth in claim 1 wherein the segment of the top edge margin of the liner that defines the liner opening and along which the front panel and the rear panel are unconnected extends continuously along the width of the liner from a first end defined by the frangible sizing seal structure and located closer to the first side margin than the second side margin to a second end located closer to the second side margin than the first side margin.

9. The liner as set forth in claim 1 wherein the front and rear panels are unconnected along a middle portion located equidistant from the first and second side edge margins of the liner, said middle portion defining a portion of the liner opening.

10. The liner as set forth in claim 1 wherein each of the plurality of sizing seals has a bottom end that is spaced apart from the bottom edge margin of the liner by a majority of the height of the liner.

11. A method of making a liner for lining a receptacle comprising:

forming a front panel and a rear panel that are joined together along a bottom edge margin, a first side margin, and a second side margin of the liner to define a liner interior and that are unconnected along a segment of a top edge margin of the liner extending between the first and second side margins to define a liner opening in fluid communication with the liner interior; and sealing together the front and rear panels along the top edge margin adjacent the first side margin to limit a size of the liner opening, said step of sealing together the front and rear panels comprising forming a frangible sizing seal structure configured to allow the frangible sizing seal structure to progressively break when the top edge margin of the liner is stretched over a rim of the receptacle to selectively enlarge the size of the liner opening, said step of forming the frangible sizing seal structure comprising forming at least two sizing seals at a corner portion of the liner that are spaced apart from one another by an unsealed portion of the top edge margin of the liner, the at least two sizing seals being aligned with one another heightwise of the liner and each of the at least two sizing seals being located inboard of the first side margin of the liner and closer to the first side margin of the liner than the second side margin of the liner;

wherein after the step of forming the frangible sizing seal structure, the liner opening is configured so that the segment of the top edge margin of the liner that defines the liner opening can be stretched over a rim of another smaller receptacle without any portion of the frangible sizing seal structure being broken;

wherein the at least two sizing seals comprise an outer frangible seal adjacent the first side margin and an inner frangible seal adjacent the liner opening;

wherein the step of sealing together the front and rear panels comprises, for each of the outer frangible seal and the inner frangible seal, at least one of heat sealing the front and rear panels together (a) over a respective seal area; (b) at a respective sealing temperature; and (c) for a respective duration; and wherein the step of sealing together the front and rear panels comprises at least one of:

heat sealing the front and rear panels together over a larger seal area for the outer frangible seal than the inner frangible seal;

heat sealing the front and rear panels together at a higher sealing temperature for the outer frangible seal than the inner frangible seal; and heat sealing the front and rear panels together for a longer sealing duration for the outer frangible seal than the inner frangible seal.

12. The method as set forth in claim 11 wherein the step of sealing together the front and rear panels comprises heat sealing the front and rear panels together over the larger seal area for the outer frangible seal than the inner frangible seal.

13. The method as set forth in claim 11 wherein the step of sealing together the front and rear panels comprises heat sealing the front and rear panels together at the higher sealing temperature for the outer frangible seal than the inner frangible seal.

14. The method as set forth in claim 11 wherein the step of sealing together the front and rear panels comprises heat sealing the front and rear panels together for the longer sealing duration for the outer frangible seal than the inner frangible seal.

* * * * *